United States Patent [19]

Lee

[11] 4,028,999

[45] June 14, 1977

[54] CARTON FORMING MACHINE

[75] Inventor: Richard G. Lee, Boston, Mass.

[73] Assignee: Econocorp, Inc., Needham Heights, Mass.

[22] Filed: Nov. 4, 1975

[21] Appl. No.: 628,738

[52] U.S. Cl. ..... 93/51 R; 93/53 LF

[51] Int. Cl.[2] ..... B31B 3/60; B31B 1/50

[58] Field of Search ..... 93/51 R, 53 LF, 49 R, 93/47, 51 M, 51 HW, 53 R

[56] References Cited

UNITED STATES PATENTS

| | | | |
|---|---|---|---|
| 3,102,456 | 9/1963 | Bailey | 93/51 R X |
| 3,168,018 | 2/1965 | Dunn | 93/51 R |
| 3,400,639 | 9/1968 | Wainberg | 93/51 R |
| 3,785,255 | 1/1974 | Talbot et al. | 93/51 R X |
| 3,913,300 | 10/1975 | Benzing | 93/51 R X |

*Primary Examiner*—James F. Coan
*Attorney, Agent, or Firm*—C. Yardley Chittick

[57] ABSTRACT

A machine for forming a precut paperboard blank into carton form with the lid extending vertically from its related back wall in unfolded condition. The forming means includes spring pressed rollers acting in cooperation with a mandrel to fold the carton side panels from horizontal to vertical and other means to cause interlocking of end tabs on the front and back panels with slits in the end panels. The structure also includes vertical slots enabling the unbent end flaps on the lid to pass downwardly therethrough as the carton is formed.

8 Claims, 8 Drawing Figures

36
38
30
6
8
2
4
G
34
12
D
L
H
J
C
F
B
A
10
E
32
26
24
16
G
14
82
F
G
28
H
14
90
16
18
14
D
76
C
42
74
68
44
I
22
88
40
M
Y
12
20
82
92
58
66
52
70
22
A
B
78
50
95
46
48
80
116
94
72

112
110
108
G
114
F
C
I
G
M
H
A
F
E
L
B
D
C
118
A
E
B

Fig. 2.
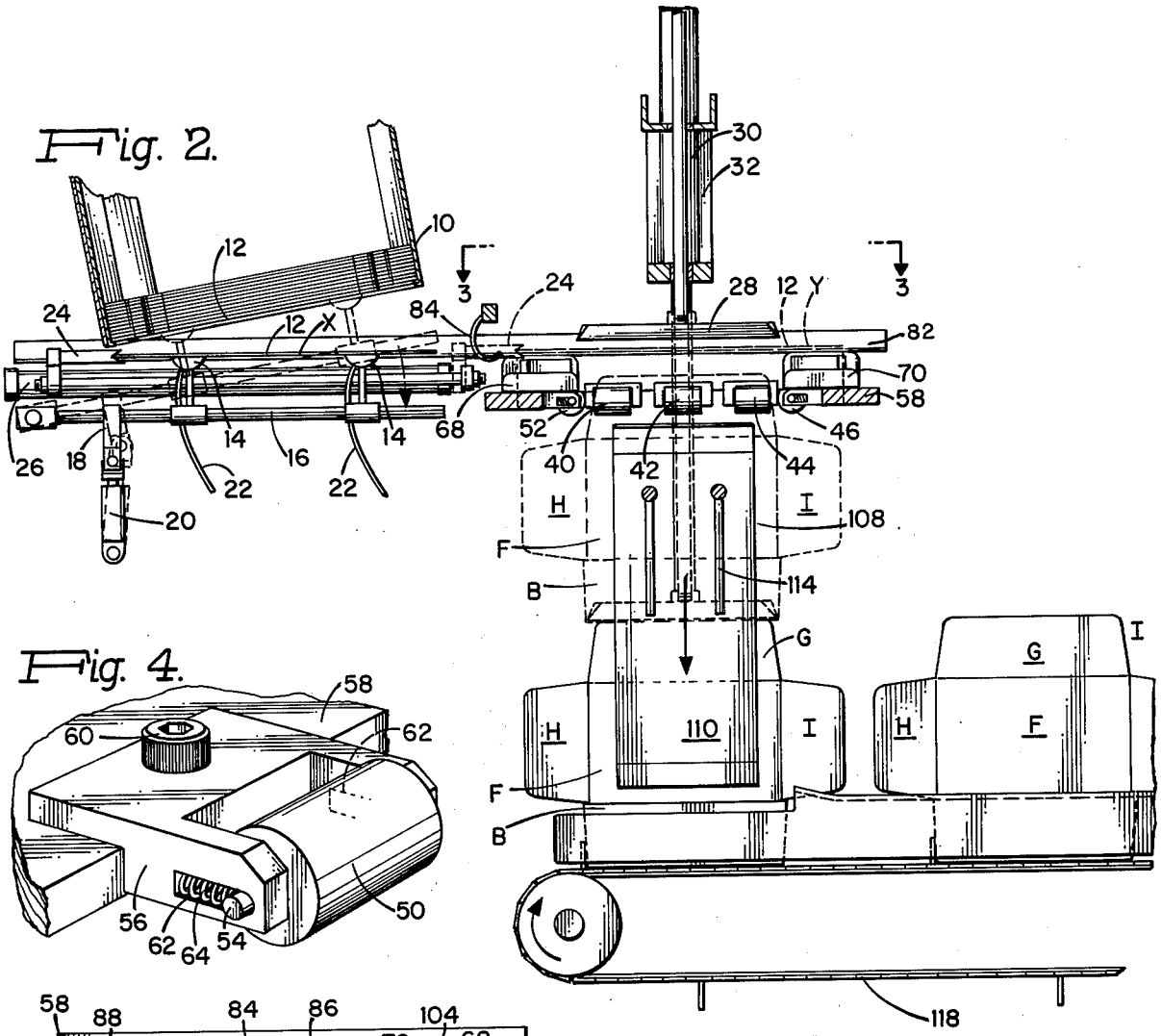
Fig. 4.
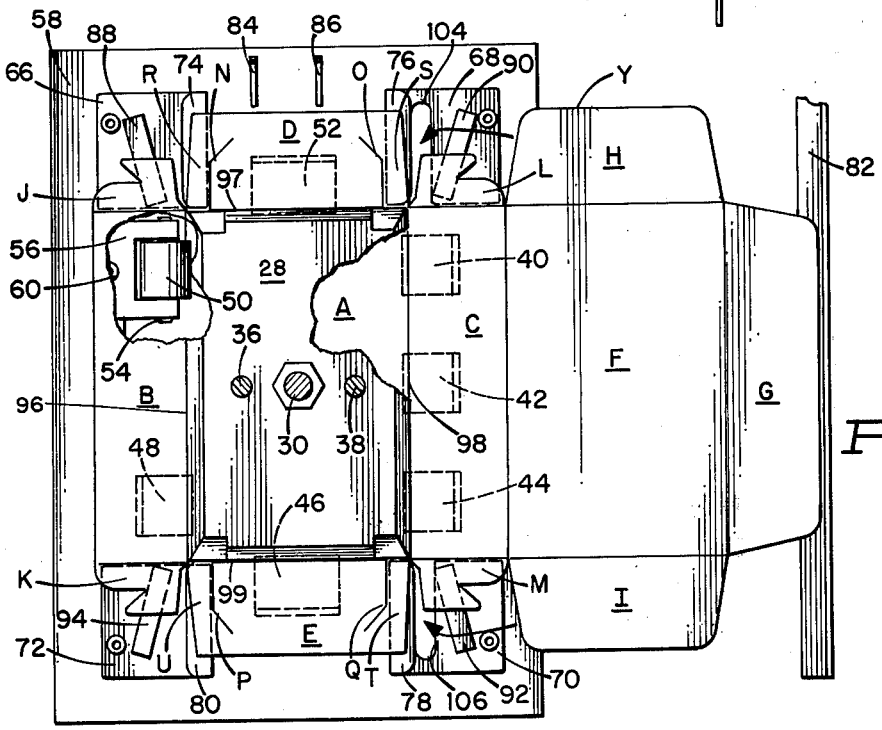
Fig. 3.

CARTON FORMING MACHINE

FIELD OF THE INVENTION

Machines for forming precut paperboard blanks into box formation in which the finished box is of conventional shape consisting of a bottom, back panel, front panel, two end panels and a lid are well known in the art. See the patent to Samsing U.S. Pat. No. 2,553,870 for Box Blank and Box, and the patent to Samsing U.S. Pat. No. 2,626,545 for Apparatus for Setting up Box Blanks. The prior art cartons of this type often include tabs on the ends of panels so that the sides will remain in erected condition without the necessity of any gluing operation.

SUMMARY OF THE INVENTION

The present invention comprises a machine in which precut paperboard blanks are fed one at a time to a forming station. The blank has bottom, front, back and end panels which when erected and locked together form the body of the carton. The end panels have slits therein which are opened sufficiently to receive interlocking tabs attached to the ends of the front and back panels. The lid extends vertically from the back panel and includes a front flap adapted to be glued to the front panel and two end flaps adapted to be glued to the end panels when the lid is in closed position.

The blank is delivered in a sidewise direction in horizontal position to the forming station in which a plurality of spring pressed rollers are arranged to define a vertical opening slightly less than the dimensions of the carton bottom. As the blank is moving to the forming station, the slits in the end panels are initially forced open by a slit opening means which acts sequentially on the end panels. A mandrel above the blank of approximately the size of the box bottom descends to engage the bottom to force it down through the opening defined by the rollers. The rollers engage the front, back and end panels of the blank, causing them to be progressively bent along score lines to vertical position. Tabs on the ends of the front and back panels are likewise bent by novel means mounted on the supporting structure at the corners of the roller defined opening so that they will enter the opened slits in the end panels and become interlocked therewith when the panels are fully erected. The lid remains in the plane of the back panel so that when the back panel has been erected to vertical position the lid will extend directly upward from the back panel.

The blank in the present invention is especially designed to include a front flap and two end flaps on the lid whereby the lid can tightly close the box by gluing the three lid flaps to the front and two end panels.

The machine includes special means whereby the two oppositely disposed end flaps extending from and in the plane of the lid are permitted to pass downwardly through the carton forming mechanism without having to be bent out of the plane of the lid.

By virtue of the construction of the machine, the erected carton can be delivered to a conveyor below the forming station with the lid and its flaps unbent with respect to the back panel and extending vertically upward to provide a carton in maximum open position whereby the carton may be loaded with food stuff or other merchandise without interference from the lid. The loaded carton is then delivered to a sealing machine which closes the lid and glues the front and two end flaps against the related panels of the erected carton. The conveyor and blank feeding means move in parallel directions.

Another feature of the machine is novel means for opening the slits in the end panels so that as erection of the panels proceeds, the tabs on the ends of the back and front panels will surely enter the slits to interlock properly with the end panels.

Another feature of the invention is the use of rollers to define the opening through which the blank is downwardly forced by the mandrel. Rolling engagement with the panels is less damaging to the carton material than the customary sliding engagement with fixed walls found in other machines. In addition the rollers are spring pressed toward the opening and are compelled to move away as the mandrel and carton pass therethrough, but then move back to fold the wall panels inwardly slightly more than 90° from the horizontal. This insures that the tabs properly interlock with the slits in the end panels.

The inward movement of the spring pressed rollers is facilitated by having the four sides of the mandrel in the form of a short four sided truncated pyramid.

These and other objects of the invention will be more clearly understood as the description proceeds with the aid of the accompanying drawings in which FIG. 1 is an isometric perspective view of the carton forming machine.

FIG. 2 is a side elevation of FIG. 1.

FIG. 3 is a plan view of the forming station with a carton blank in place taken along the line 3—3 of FIG. 2.

FIG. 4 is a detail view of one of the spring pressed rollers that define the opening through which the blank passes.

DESCRIPTION OF A PREFERRED EMBODIMENT

Figure 1:
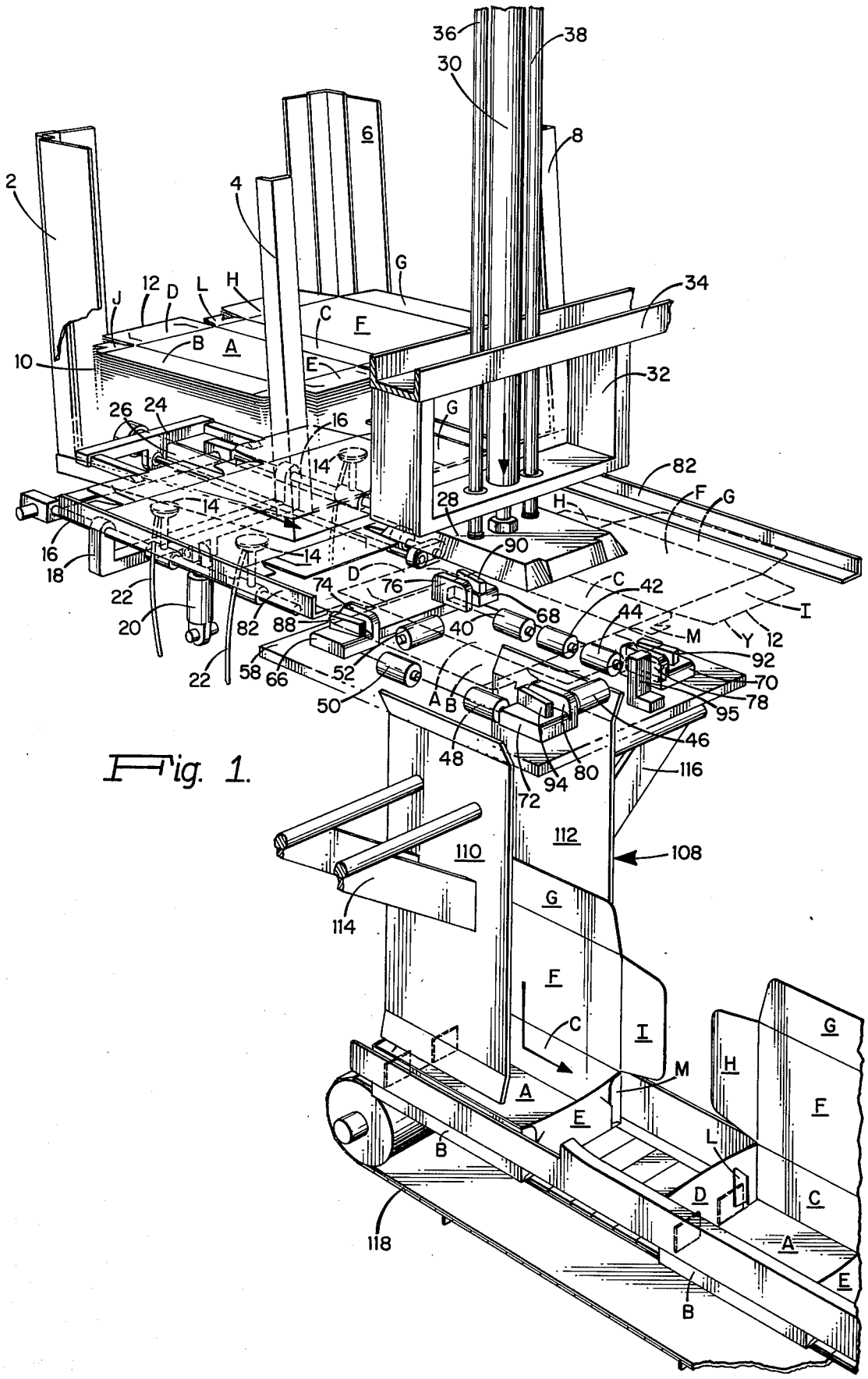

Referring first to FIG. 1 there is a general outer housing not shown which acts to support the various operating elements. Some of the associated supports are shown at 2, 4, 6 and 8 which carry the blank magazine 10. The magazine 10, contains a pile of precut paperboard carton blanks 12.

The shape of each individual blank is best shown in FIG. 3. The blank comprises a bottom A, a front panel B, a back panel C, a first end panel D, a second end panel E, a lid F, a front flap G, an end flap H, and a second end flap I. The front panel B has on its ends tabs J and K and the back panel C has on its ends tabs L and M. The end panel D contains two slits N and O and the end panel E has two slits P and Q. As will be more fully explained hereinafter the tabs J, K, L and M are caused to interlock with the slits N, P, O and Q respectively when the wall panels are erected.

Referring now to FIGS. 1 and 2, suction cups 14 mounted on pivoted bars 16 which in turn are carried by a U-shaped support 18, are raised by the piston of cylinder 20 to engage the bottom blank in magazine 10. Suction is applied through hoses 22 so that when piston moves downwardly in cylinder 20, the bottom blank is drawn down to the position X shown in FIG. 2. The suction in cups 14 is then released.

A pusher unit 24, actuated by a piston and cylinder arrangement 26 advances the blank 12 to the position Y where it is located beneath a mandrel 28 actuated for up and down movement by a cylinder and piston 30. The piston is supported by a suitable frame 32 carried by a transverse member 34. Guide rods 36 and 38 attached to the mandrel 28 prevent rotation as it is moved up and down.

As the blank moves from the magazine to the forming station at Y, it is said to move sideways. That is, it moves in the direction of the axis of bottom A that extends through the end panels.

Referring to FIGS. 1, 2 and 3 it will be seen that there is an opening in the framework directly below the bottom A of the blank when it is at position Y. This opening is defined by a plurality of preferably identical rollers 40, 42, 44, 46, 48, 50 and 52. Each of the rollers (of which roller 50 is illustrated in FIG. 4) is carried by an axle 54, the ends of which are mounted in the arms of a frame 56 attached to a supporting plate 58 by a screw 60. The ends of axle 54 reside in slots 62 in which are springs 64 urging the axle 54 and its associated roller toward the opening defined by the rollers. All of the rollers are mounted in the same manner and all are freely rotatable.

Also mounted on supporting plate 58 are four corner units 66, 68, 70 and 72. Unit 66 has a raised portion or knuckle 74 which underlies the end portion R of end panel D outwardly of slit N. Similar raised portions or knuckles 76, 78 and 80 on the corner units 68, 70 and 72 underlie the end portions S, T and U of the end panels D and E beyond the slits O, Q and P respectively.

These raised portions 74, 76, 78 and 80 are higher than the rollers and, aided by a rail 82, support the blank 12 over the opening defined by the rollers prior to downward movement of mandrel 28.

Figure 5:
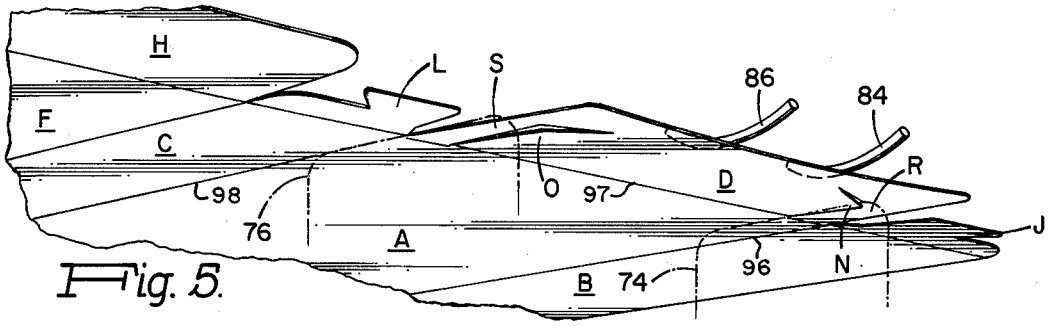
FIGS. 5, 6 and 7 illustrate progressive stages in the erection and interlocking of the wall panels of the box.

As the blank 12 was being moved sideways by pusher 24 to position Y, the center part of end panel E, bottom A and end panel D successively passed under presser elements 84, 86 whose blank engaging surfaces are at a level lower than the knuckles 74 and 76. See FIGS. 2, 3 and 5. The effect of this arrangement is to cause the slits P and Q in panel E and the slits N and O in panel D to be positively opened as the blank in flat unfolded condition advances to position Y. This initial opening of the slits facilitates subsequent opening to receive the tabs as the panels are erected.

However, it will also be noted that because of the sideways movement of the blanks, only the end panel E and the bottom A pass over the opening defined by the rollers 40, 42, 44, 46, 48, 50 and 52.

Figure 6:
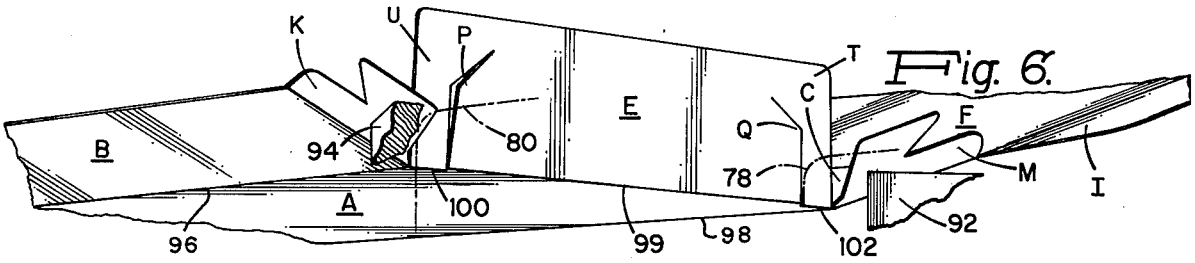

The corner units 66, 68, 70 and 72 also contain tab benders 88, 90, 92 and 94. As seen in FIGS. 3 and 6, the ends of these tab benders are located respectively under tabs J, L, M and K so tht as the walls or panels of the box are being erected, the ends of the tabs will enter the adjacent previously opened slits N, O, Q and P in the end panels D and E to provide the required interlocking to maintain the carton formation.

When the carton blank 12 is delivered to the position Y by the pusher 24 it will engage stop 95 (see FIG. 1) to be accurately located longitudinally under mandrel 28. The tracks 82 on which the sides of the blank have traveled during the advance of the blank accurately locate the blank transversely under the mandrel.

With the blank now correctly positioned under mandrel 28 and over the opening defined by the rollers, the piston of cylinder 30 is actuated so the mandrel descends and directly engages the bottom A of the blank. The downward movement is rapid so that the panel B immediately engages rollers 48 and 50, panel D engages roller 52, panel C engages rollers 40, 42 and 44 and panel E engages roller 46. The result is that these four panels are immediately and progressively bent from horizontal to vertical along the crease lines present in the blank. These crease lines are indicated at 96, 97, 98 and 99. The crease lines 96 and 98 are straight for their full length but the crease lines 97 and 99 have inwardly offset sections adjacent the end portions R, S, T and U. These offset portions may be observed in FIG. 6 at 100 and 102. The effect of this offset is that when the end panels D and E are turned from horizontal to vertical by the descent of mandrel 28, the already opened slits N, O, P and Q will open sufficiently to receive the respective tabs J, L, M and K as the bending toward vertical proceeds.

It will also be noted in FIGS. 1, 2 and 3 that the mandrel 28 is relieved at the corners on the sides about which the end panels D and E are folded. This relief results in increasing the width of the slit openings by providing spaces into which the end portions R, S, T and U of panels D and E may move while the center portions of end panels D and E are restrained by the unrelieved sides therebetween. The slope of the pyramidal sides of the mandrel is about 15° while the slope of the relieved corner areas is about 30°.

Figure 7:
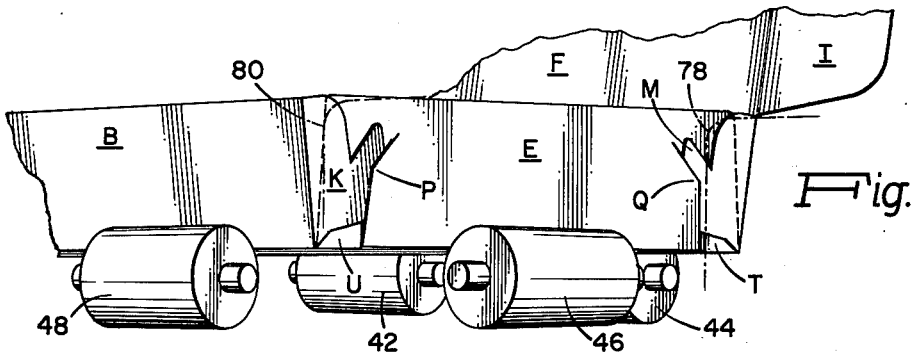
Figure 8:
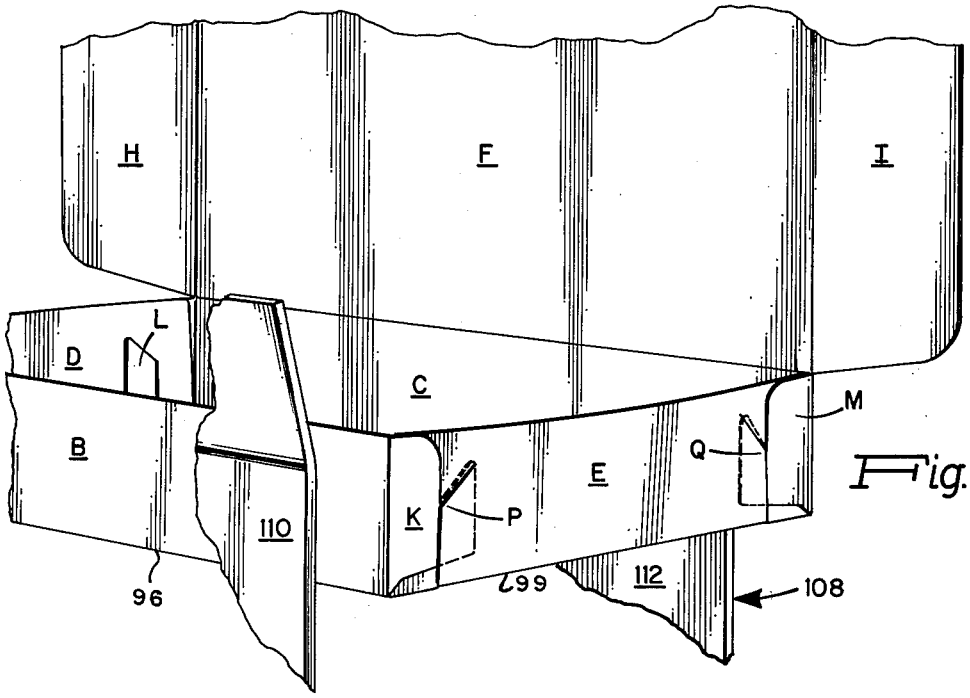
FIG. 8 is a perspective view of the finished carton as it is delivered to the chute leading to the conveyor below. The lid in this view has been broken away in part.

Also as illustrated in FIG. 6, the tab benders 92 and 94 act against the undersides of tabs M and K so that the tabs are bent inwardly to a position between panel E and the ends of knuckles 78 and 80 to enter the open slits Q and P as shown in FIG. 7.

As the downward movement of the blank proceeds the rollers will progressively bend the wall panels to vertical and the tabs will have entered their respective slots as indicated in FIG. 7. When the plunger 28 has passed the rollers the walls B and C will have gone somewhat beyond vertical position so that the related tabs will have become interlocked with the end panels to make the box portion of the carton structurally secure.

It will be noted that when the back panel C is bent to vertical position the lid F is also swung to vertical position to remain in the same plane as panel C. Note also that there has been no bending of the end flaps G, H and I which remain unbent with respect to lid F. Accordingly a feature of the invention is the construction of corner units 68 and 70 whereby the end flaps H and I can pass downwardly through the corner units and the supporting plate 58 therebelow. This result is accomplished by having vertical passages 104 and 106 through corner units, 68 and 70 with corresponding openings therebelow in supporting plate 58. Passage 104 is between knuckle 76 and tab bender 90, and passage 106 is between knuckle 78 and tab bender 92. Thus as the back panel C is swung to vertial position as it moves downward past the rollers 40, 42 and 44, the end flap H will move unobstructed downwardly through passage 104 and the end flap I will likewise move downwardly unobstructed through passage 106.

The completed carton is then delivered by the mandrel 28 to the chute 108, comprised of spaced walls 110 and 112 adjustably mounted on the supporting structure by suitable braces 114 and 116.

As the mandrel 28 is retracted, the completed carton is stripped from the mandrel and falls by gravity to the conveyor 118 which moves it horizontally along a path where it may be loaded with merchandise prior to going to a lid sealing location.

The desirability of having the lid F unbent with respect to back panel C and the end flaps H and I and front flap G of lid F likewise unbent may be appreciated by observing the condition of the cartons on the conveyor shown in FIG. 1. The carton lid is completely out of the way so that the subsequent loading operation may proceed unimpeded.

The blank feeding operation and the down and up movement of mandrel 28 are timed by the use of conventional limit switches actuating valves which feed compressed air to the cylinders 20, 26 and 30 at appropriate times so that a proper sequence may be maintained to form the blanks into cartons at a rate adequate to meet the carton loading requirements. These operation sequences are controlled by conventional means which need not be illustrated or explained in further detail as they are well understood in the art.

The above disclosure will suggest to others skilled in the art modifications which are within the scope of the invention as defined by the appended claims.

I claim:

1. Apparatus for forming a carton blank comprised of a bottom, front and back panels with end tabs, end panels with slits therein adapted to receive said end tabs, and a lid with front and end flaps, into carton form with the lid in open vertical position and with the lid end flaps extending in the plane of the lid, said apparatus comprising a plurality of spring pressed rollers arranged to define a rectangular opening slightly smaller than the said bottom, means for feeding flat blanks horizontally from a supply source to a supported position over said opening, said feeding means arranged to direct said blanks sideways so that in reaching the position over said opening, only one end panel and the said bottom pass over said opening, first means for initially opening said slits in said end panels while said flat blank is being moved sideways to position over said opening, a mandrel arranged to descend to engage the said bottom to force said blank downward past said rollers whereby said front, end and back panels will engage said rollers and will be bent to vertical position, other means for maintaining said slits in open position as the said end panels are being bent toward said vertical position, means adjacent but spaced laterally from said other slit opening means to cause the said end tabs to be bent toward and to enter said open slits from the outer sides of said end panels as the bending of said front, end and back panels toward vertical is proceeding, and vertical passages between the other slit opening means and the said tab bending means that are adjacent the ends of said back panel through which the end flaps extending from the lid may pass when the back and lid together have been bent to vertical position and said now erected carton is being moved downwardly by said mandrel past said rollers.

2.The construction set forth in claim 1, said first means for initially opening said slits comprising two spaced knuckles located to be under the ends of said end panels as said end panels pass thereover en route to final position below said mandrel, and means between said knuckles pressing the central portion of said moving end panels down to a level below the tops of said knuckles.

3. The construction set forth in claim 1, the supports for said blank when positioned over said opening comprising four knuckles located under the ends of said end panels, said knuckles cooperating with said downward moving mandrel to bend said end panels toward vertical and to compel opening of said slits to receive said tabs as the tabs are being bent by said tab bending means during downward movement of said blank.

4. The construction set forth in claim 3, said mandrel having sides sloping upwardly and inwardly, the end portions of the said sides that are adjacent said end panels and aligned with said knuckles being relieved whereby on descent of said mandrel the ends of said end panels that are exterior of said slits may be bent farther beyond vertical than the central portions of said end panels.

5. The construction set forth in claim 1, said blank having creases between said bottom and said front, back and end panels to insure sharp corners when said front, back and end panels are erected as said mandrel descends, the crease between the said bottom and each said end panel being offset inward toward said bottom at the crease ends whereby when the end panels are being bent toward vertical by descent of said mandrel, the end portions of said end panels exterior of said slits will open to a greater degree than if said crease end had not been offset.

6. Apparatus for forming a carton blank comprised of a bottom, front and back panels with end tabs, end panels with slits therein adapted to receive said end tabs, and a lid with front and end flaps, into carton form with the lid in open vertical position, said apparatus comprising a rectangular mandrel, a supporting plate, a plurality of rollers on horizontal axles arranged on said supporting plate to define a rectangular opening located below said mandrel, means for moving a carton blank sideways to a position over said opening, the movement of said blank being in the direction of the axis of the bottom that extends through said end panels, whereby only one end panel and said bottom pass over said opening as the blank arrives at said position, means for driving said mandrel downward through the said defined opening whereby the front, back and ends of said blank will engage said rollers and be folded to vertical positions as the mandrel passes said rollers, means located adjacent the corners of said defined opening to cause the slits in said end panels to open and the tabs on said front and back panels to be folded to enter said slits as the said front, back and end panels are being folded to vertical position, the means for opening said slits comprising knuckles on which rest the end portions of said end panels prior to and during the first part of the descent of said mandrel, the means for folding said tabs during descent of said mandrel comprising raised elements adjacent said knuckles and located directly under said tabs, said raised elements being of less height than said knuckles whereby bending of said end panels commences before bending of said tabs as said mandrel descends.

7. The construction set forth in claim 6, said knuckles and the means for folding said tabs that are locted at the ends of the said back panel being spaced laterally from each other to provide two vertical passages, and aligned passages through said supporting plate through which the end flaps of said lid may pass as the mandrel is forcing said blank downward.

8. The construction set forth in claim 6, and means for pressing the central portion of each said end panel downward while the blank is moving sideways and while the ends of each said end panel are supported by two of said knuckles whereby said slits will be initially opened while said blank is still in flat condition.

* * * * *